United States Patent [19]

Mueller et al.

[11] 4,108,597

[45] Aug. 22, 1978

[54] PROCESS FOR IMPARTING PUCKER AND COLOR EFFECTS TO FABRICS

[75] Inventors: Klaus Karl Mueller, Armonk, N.Y.; James Osborn E. Loughlin, Lubbock, Tex.

[73] Assignee: Cotton Incorporated, New York, N.Y.

[21] Appl. No.: 769,886

[22] Filed: Feb. 18, 1977

Related U.S. Application Data

[63] Continuation-in-part of Ser. No. 657,648, Feb. 12, 1976.

[51] Int. Cl.[2] ..... D06M 1/08; D06M 13/00

[52] U.S. Cl. ..... 8/115; 8/17; 8/65; 8/66; 8/114; 8/114.5; 8/127

[58] Field of Search ..... 8/114.5, 115, 66, 17, 8/127, 65, 114

[56] References Cited

U.S. PATENT DOCUMENTS

| | | | |
|---|---|---|---|
| 2,244,767 | 6/1941 | Corbett et al. | 8/115 |
| 2,352,409 | 6/1944 | Robinette | 8/127 |
| 3,089,747 | 5/1963 | Welch | 8/114.5 |
| 3,409,657 | 11/1968 | Blood et al. | 8/127 |
| 3,893,937 | 7/1975 | Landauer et al. | 8/125 |

FOREIGN PATENT DOCUMENTS

| | | | |
|---|---|---|---|
| 592,649 | 9/1947 | United Kingdom | 8/114.5 |

OTHER PUBLICATIONS

The Effect of Crosslinking on the Swelling of Cotton in Solutions of Sodium Hydroxide and Cadoxen: J.A.P.S., vol. 14, pp. 655–665 (1970).

*Primary Examiner*—John Kight, III

*Attorney, Agent, or Firm*—Burns, Doane, Swecker & Mathis

[57] ABSTRACT

Polymer-containing, crosslinked, durable press 100% cotton, high-cotton blend, and other cellulosic fabrics are given a durable pucker without steaming by treatment with a rewetting agent, followed by drying, printing with a caustic printing paste permitting the printed fabric to develop a pucker at room temperature in a substantially tension-free state, and washing. Alternatively, the application of the rewetting agent can be bypassed by adding compatible wetting agents directly to the printing paste. The present process is also compatible with pigment printing processes so that caustic printing and pigment printing can be combined, the cold-puckered fabric being dried and then heated to set the pigment vehicle.

22 Claims, No Drawings

PROCESS FOR IMPARTING PUCKER AND COLOR EFFECTS TO FABRICS

RELATION TO OTHER CASES

This application is a continuation-in-part of our U.S. application Ser. No. 657,648, filed Feb. 12, 1976.

BACKGROUND OF THE INVENTION

In our above-mentioned copending application, the contents of which are hereby incorporated by reference, there were disclosed fabrics having novel durable, wavy, pucker or crinkle and dyed effects, contrasting with plain flat background areas, which were produced, for example, in cotton-containing woven or knit fabrics by impregnating the fabric with a polymer-forming, crease-proofing composition which is also capable of crosslinking the cellulose of the cotton fibers, curing the impregnated fabric to condense the polymers and crosslink the cellulose, and applying caustic alkali to selected areas of the fabric to disrupt the cellulose crosslinks and the polymer in those fabric areas. The fabric was then steamed in the substantial absence of tension, neutralized and washed. The resulting product has flat, shrunken areas where the alkali destroyed the polymers and the cellulose crosslinks, and durable, launder-resistant puckered areas where the crosslinks and polymers remained intact and prevented the fabric from shrinking. In addition to imparting an attractive puckered appearance, as disclosed in our copending Ser. No. 657,648, the invention, when applied in suitable patterns, is capable of producing fabrics having good durable press properties combined with superior physical strength and reduced shrinkage. The process is applicable to desized greige, bleached white fabrics, as well as to dyed or printed fabrics. By properly selecting the dyes and dyeing the fabrics before crease-proofing and after alkali treatment, multi-tone effects can be obtained.

As disclosed in Ser. No. 657,648, 100% cotton or high cotton-content fabrics, in which a polymer-forming, crosslinking agent has been installed and cured is treated with a thickened printing paste containing at least 25% caustic to attack the polymeric crosslinking agent, thereby destroying the links and the polymer and unlocking the energy which has been stored in the fibers. As a result, there is induced a massive, dramatic contraction. When the caustic is applied to local selected areas, only the latter shrink, while the remaining, adjacent areas of the fabric retain their crease-resistant, shrink-proof character and their original area dimensions. The result is a cotton or cotton-containing fabric having flat, shrunken areas adjacent to, surrounded by, or themselves surrounding wrinkled or puckered areas, depending on the pattern in which the caustic has been applied.

Since it is also known that cellulosic fabrics, rendered durably press retentive or crease-resistant by means of crosslinking agents suffer from at least about a 40% loss of physical strength, the invention disclosed and claimed in our copending application is capable of resulting in an additional benefit by producing treated fabrics which can approach untreated fabrics in strength. Thus, if the caustic is applied in a pattern, random or otherwise, which pattern comprises a plurality of connected areas, there is formed a continuous matrix of uncrosslinked fibers causing the fabric to have an overall, significant advantage over a similar fabric which has had only the conventional durable press treatment applied to it. Thus, in accordance with the invention disclosed in Ser. No. 657,648, there results a regain in strength so that the ultimate strength loss is no greater than about 10–15%.

The process of the above-referred to invention can be applied, for example, to natural or bleached white fabrics, solid piece-dyed fabrics, multi-tone piece-dyed fabrics, or printed fabrics. By selecting appropriate combinations of alkali-resistant and alkali-sensitive dyes and applying them at predetermined stages of the process, substantially unlimited color combinations of crinkled patterns can be obtained. Furthermore, particular pucker effects can be produced by choosing specially designed yarn or fabric constructions. In addition, manipulation of planned one- or multi-directional fabric tension, combined with subsequently induced chemical-mechanical relaxation, can result in a variety of different degrees of waviness or puckering.

In carrying out the process of our copending application, it was necessary that the caustic-printed, crosslinked fabric be steamed, while in a substantially tension-free state, in order to destroy the crosslinks bridging the cellulose molecules and the polymers in the printed areas to cause the fabric to shrink and to develop the pucker in the caustic-free, unprinted areas. For best results, the steam pucker process requires a steamer in tandem with a printing range.

The process disclosed in our copending application could, in general, frequently be carried out with little capital investment because many plants for finishing fabrics already had the necessary printing and steaming facilities, while resin-treated fabrics were readily obtainable if they were not actually also made on the same premises.

Although the steam pucker process is entirely satisfactory, certain trends in the fabric finishing industry made it desirable to seek a method whereby the steaming step could be eliminated. This search for a method to eliminate the steaming step resulted from a survey which revealed a growing number of plants in which the coincidence of printer-steamer facilities was no longer as widespread as formerly. The present invention not only eliminates the steaming, but also reduces the time of the overall process, thus resulting in a considerable saving of energy and an overall improvement in the economy of the process. Furthermore, because the combination of steam and caustic tend to create a reducing potential to which many dyes are sensitive, elimination of the steaming step now makes it possible to obtain sharper, more brilliant colors with certain dyes.

Among the background prior art discussed in copending Ser. No. 657,648, reference was made to U.S. Pat. No. 2,810,624 (Waddell) which discloses a proposed method involving treating a cellulosic fabric over all its area with an aqueous solution of dimethylolethyleneurea; drying and heat-curing the treated fabric under tension; locally applying a shrinking agent, such as caustic soda; and then washing the fabric. An essential element of the proposed method was that it expressly excluded polymer-forming treating agents and was restricted to the use of dimethylolethyleneurea because that compound was only a crosslinking agent, but did not form insoluble, fiber-ensheathing polymeric coverings or fillings. The shrinking agent could be applied as a thickened, aqueous caustic soda solution at room temperature, somewhat elevated temperatures, or under refrigeration. However, when it is desired to apply the patented process to high count, tight weave fabrics and those containing rayon fibers, a water repellent material is applied to the fabric prior to application of the caustic printing paste to assure sharp outlines and to prevent "wicking" or "feathering", i.e., migration of the caustic paste away from the edges of the printed area.

Another method, proposed in U.S. Pat. No. 3,089,747 (Welch) and limited to the production of pucker effects on regenerated cellulose rayon, involves treating a rayon fabric with a water soluble cellulose ether, a crosslinking agent comprising either an aldehyde or a polyfunctional aldehyde derivative, and an acidic catalyst. After a heat-cure the fabric is printed with a thickened caustic composition and allowed to stand until the pucker developed. Optionally, patentee may add a thermoplastic amine-aldehyde condensation product to the cellulose ether solution to add body to the final product. However, where this is done, the fabric is steamed after application of the caustic paste to develop the desired pucker.

Although the above-described proposals and those additionally discussed in our copending application were asserted by the respective patentees to result in definite improvements in puckered fabrics, the proposed processes do not appear to have achieved commercial success. None of the proposed processes, moreover, was indicated to be applicable to cotton knit fabrics.

OBJECTS OF THE INVENTION

A principal object of the present invention is to provide a practical process for producing a durable press 100% cotton, high cotton content or other cellulose containg fabric having durable, wash-resistant pucker or bubble effects without the necessity of steaming the fabric after it has been caustic-printed. A further object is to provide such a process in which the elimination of the steaming step does not unduly increase the time required for completion of the process. Another object is to provide such a steaming-free process which produces a fabric in which the pucker effects are distributed in selected areas in a predetermined pattern or design such that strength losses which normally attend durable press treatments are minimized. A related object is to provide a steaming-free process which results in lighter-weight fabrics without sacrificing strength and in which the washing shrinkage is reduced to and maintained within the trade-accepted levels. Still another object is to provide a steaming-free process capable of producing such pucker or bubble effects on knit cotton, high cotton content, or other cellulose containing fabrics, in addition to woven fabrics. A further object is to provide a steaming-free method for producing a puckered fabric whereby the finished product will have either a print or uniform dyed color, or have multi-tone effects in which puckered areas will be of one shade or color and intervening flat areas will be either white or of a color or shade different from that of the puckered areas. Yet another object is to provide a steaming-free process which is compatible with pigment printing processes.

These and other objects, which will become apparent to those skilled in the art, are achieved by means of the present invention as described and exemplified below.

SUMMARY OF THE INVENTION

It has now been discovered, in accordance with the present invention, that, if the polymer-containing, dried, and cellulosic cured fabric, comprising 100% cotton, blends containing at least 40% cotton, or rayon, produced as described in the general procedure disclosed in our copending application Ser. No. 657,648, is printed with a caustic printing paste, as also described in that application, in the presence of a suitable wetting agent, a full pucker will develop if the printed fabric is permitted to remain at room temperature under substantially no tension for between about 2 to 20 minutes.

In a preferred embodiment, the wetting agent can be added directly to the printing paste or, in an alternative procedure, the resin-treated goods can first be impregnated with a re-wetting agent, dried, and then printed with a caustic printing paste such as is disclosed in our above-mentioned copending application. After printing, the fabric is permitted to remain at room temperature under substantially no tension for about from 2 to 20 minutes until a full pucker is developed.

The term "re-wetting agent," as used above, is a well-known term and, throughout this specification, refers to a surface-active agent which, when installed in the fabric and the latter dried, allows the caustic printing paste to penetrate the cotton fibers at room temperature without the need to subject the fabric to steaming to cause penetration of the caustic.

After the pucker has developed under either of the above-described alternative procedures, the fabric is washed, preferably, but not necessarily, under little or no tension, neutralized and dried.

A requisite property of the wetting agent is that it be capable of functioning without rapid deterioration in a highly caustic environment because the concentration of alkali in the printing pastes used in the process of the present invention (25–33.3% or higher) is greater than is generally encountered in the fabric finishing industry.

The wetting agents which have been found to give particularly good performance in the process of the present invention belong to the general classes of lower aliphatic sulfates and phosphates, salts of sulfated lower alkyl ethers, alkoxylated amines and blends of such amines with higher fatty acid amides, and salts of sulfonated esters of lower aliphatic dibasic carboxylic acids.

In addition to withstanding the high alkalinity when incorporated into the printing pastes, the wetting agents useful in the present invention are also capable of withstanding the "salting out" effect of the strong caustic. Without being bound by the correctness of the following explanation, suitable wetting agents falling into the above-stated general classes may be considered to have relatively high inorganic moieties in the total structure and can, in a partial sense, be considered electrolytes. Wetting agents having relatively high molecular weight organic moieties behave as non-electrolytes and tend to be "salted out" by strong concentrations of electrolytes, that is, they tend to be thrown out of solution. Thus, wetting agents suitable for incorporation into high caustic concentration printing pastes in accordance with the present invention can be further characterized as organic oxygen-containing compounds having relatively low molecular weight organic moieties combined with inorganic acids.

It has further been found that, although some of the suitable wetting agents are salted out of water solutions of caustic of necessary concentration, the thickening agents exert a protective action and permit incorporation of the wetting agents into the printing pastes containing high concentrations of caustic which would normally present compatibility and solublity problems for the wetting agents.

Rewetting agents need not meet the alkaline stability requirements of the wetting agents, as long as they are capable of wetting the neutral polymer-containing fabric and retain their wetting ability long enough to promote rapid wetting of the fabric as soon as the caustic printing paste is applied.

In addition to providing an improved method of obtaining a durable pucker on white fabric, the present cold process permits fabrics to be dyed prior to treatement with the polymer, prior to puckering, and after puckering. Because the steaming in the hot process develops a high reducing potential, many dyes are decolorized or drastically altered in hue during steaming. Elimination of steaming in the cold process of the present invention extends the list of dyes which withstand the pucker process. When dyeing already puckered fabrics, direct, reactive and other cotton dyes can be applied to the level (printed) portions of puckered goods practically identically as they would be dyed on any polymer-free cotton. The puckered portions will remain substantially undyed or only lightly dyed.

In the hot process, vat dyes are incorporated into the caustic printing paste with reducing agents added. On steaming, the vat dyes are reduced simultaneously and color the printed areas. Since steaming is not part of the present cold process, vat dyes are not applicable in the same manner. However, these dyes, if added to the caustic paste, can be developed if the cold-processed goods are steamed at a convenient time before washing. Alternatively, vat dyes can be dyed on the flat, resin-free areas as with any resin-free cotton.

The process of the present invention is also advantageous for producing puckered cotton-blend fabrics which contain a proportion of polyester. Although polyester is attacked by strong caustic at high temperature, it is relatively impervious to degradation by caustic at low temperatures. The process of the present invention is, therefore, better adapted to the production of puckered cotton-polyester blend fabrics than the hot process of Ser. No. 657,648.

Another preferred aspect of the present invention is its unexpected compatibility with, and applicability to, the increasingly prevalent pigment-printing processes which involve printing cotton with a pigment-containing composition and then heat-curing to set the pigment.

The invention will now be described in detail below:

GENERAL PROCEDURE

The basic procedure for obtaining durably-puckered fabrics by the cold process of the present invention is outlined below:

1. 100% cotton fabrics, or high cotton content blends containing at least 40% cotton are prepared in a known manner up to and including bleaching.

2. The bleached (or dyed) goods are treated with a solution containing a cellulose crosslinking agent and a polymer-forming agent, as in our copending application.

3. After curing to insolubilize the polymer-forming agent and to crosslink the cellulose, the polymer-containing and crosslinked fabric is printed with a caustic printing paste and also with a wetting agent, as described in the examples below, and allowed to stand at room temperature under substantially no tension in a scray, truck, etc., until full pucker develops (2 to 20 minutes). The puckered fabric is then washed (preferably under little or no tension), neutralized, rinsed and dried.

In the above general procedure, the wetting agent is preferably added directly to the caustic printing paste. Alternatively, the cured, polymer-containing fabric can be padded with an aqueous solution of a re-wetting agent and then dried. After being dried, it is printed with the caustic printing paste, allowed to stand at room temperature until the pucker develops, and then washed, neutralized, rinsed, and dried.

In preparing the fabric for the cold pucker treatment in accordance with the present invention, the same procedure as disclosed in our copending application can be followed. Thus, any of the commercially available crosslinking agents capable of forming insoluble, resinous polymers and capable of crosslinking cellulose to impart durable press properties to cotton or cotton-containing fabrics can also be used in the process of the present invention. More particularly, among the polymer forming materials useful herein there are included any one or a combination of the easily hardenable precondensates which are substantially water soluble and are obtained by condensation of formaldehyde with a compound such as a lower alkyl substituted melamine or a urea. As is well known in the resin treating art, these precondensates are capable of being applied to the cellulosic material from an aqueous solution and to be readily insolubilized on the cellulosic material as disclosed, for instance, by Getchell in U.S. Pat. No. 3,138,802, which disclosure is herewith incorporated by reference. Triazines obtained by condensing a lower alkyl-substituted melamine and formaldehyde are examples of such precondensates. Good results are obtained, for instance, using precondensates obtained by condensing 1 mole of melamine or an alkyl substituted melamine with 2 to 6 moles of formaldehyde, i.e., using di-, tri- or hexamethylol melamine. Commercially available products of this nature include "Aerotex 23," an alkylated melamine-formaldehyde precondensate; "Aerotex M-3," a dimethoxymethylol-hydroxymethylmelamine; "Aerotex P-225," hexakis (methoxymethyl) melamine; and "Aerotex 19," which is a less completely fractionated modification of "Aerotex P-255." These products are supplied in the form of aqueous solutions by American Cyanamid Company. Also suitable for use in the present process are crosslinking agents including the highly reactive condensates of a formaldehyde and a 5-membered cyclic ethylene urea of the kind shown in U.S. Pat. No. 3,177,093, the disclosure of which is also incorporated by reference. Also useful are products such as the crosslinking agent, dihydroxydimethylolethyleneurea, "DHDMEU," especially when used in combination with a polymer-forming material, as well as modified propylene urea compounds such as "Fixapret PCL," available from Badische Anilin and Sodafabriken. Condensates having at least one and one-half moles of formaldehyde combined as methylol formaldehyde with a cyclic urea are suitable and the dimethylol derivatives are preferred. However, it is similarly feasible to use other known crosslinking agents such as the rapidly acting triazones, N-methylol carbamates, and aldehydes themselves such as formaldehyde, glutaraldehyde, and glyoxal, as well as tris (1-aziridinyl) phosphine oxide, etc. A specific illustration of a preferred material is the hardenable reaction product of urea and formaldehyde.

In addition to using the hardenable aminoplast resins, crosslinking can be done by the formaldehyde-sulfur dioxide vapor phase process disclosed by Swidler et al. in U.S. Pat. No. 3,706,526.

As stated above, a single crosslinking resin precondensate can be used or several such agents can be used in combination, and to them can be added other hardenable resins, such as acrylates, if desired, as well as softeners, surfactants, and other agents commonly added to textile finishing compositions.

PREFERRED EMBODIMENTS

EXAMPLE 1

Cotton sheeting was padded with an aqueous solution having the following composition:

12.5 lb. "Permafresh 197"
25.0 lb. "Permafresh LF"
25.0 lb. "Duroguard FF"
4.0 lb. "Catalyst KR"
1.0 lb. "Triton X-100" (surfactant)
20.0 lb. "Mykon 333" (fatty acid amide softener)
Water to make 500 lb.

In the above formulation, "Permafresh 197," produced by Sun Chemical Company, is predominantly dimethylol-s-triazone. Although primarily a crosslinking agent, it also has polymer-forming properties. "Permafresh LF," also produced by Sun Chemical Company, is predominantly dimethyloldihydroxyethyleneurea, and is primarily a crosslinking agent. "Duroguard FF," produced by the Tanner Company, is a self crosslinking, acrylic, polymer-forming emulsion, containing a catalyst; "Catalyst KR" is a buffered magnesium chloride solution sold under that name by Sun Chemicals; "Triton X-100" is an alkyl aryl polyester alcohol surfactant sold by Rohm and Haas; and "Mykon 333" is a fatty amide fabric softener also by sold by Sun Chemicals. In place of the magnesium chloride catalyst, one can use other catalyst such as zinc nitrate.

The above composition was padded onto the fabric at about 100° F. in an amount to produce a solid add-on of about from 5–10% (about 70% wet pick-up). After drying at about 220° F., the fabric was baked at about 300° F. for about 100 seconds to cure the resin and crosslink the cellulose.

The dried and cured fabric was then printed in a pattern comprising a series of parallel lines with a printing paste prepared as follows:

To 1000 lbs. cold water, which is being agitated, sprinkle in:

18 lbs. Tapioca flour and then
42 lbs. White Corn Dextrine then add gradually:
460 lbs. Caustic Soda Flakes Agitate 60 minutes while cooling. Cool and add while stirring:

10 to 60 lbs. Diethyleneglycol
10 to 60 lbs. of "Seccoterge CT".

The thickeners. i.e., the tapioca flour and white corn dextrine, can be increased or decreased in amounts to achieve a desired visocity.

In place of the diethyleneglycol, other humectants such as a suitable polyethyleneglycol, glycerine, isopropanol, and the like can be used.

"Seccoterge CT" is a modified alcohol ethoxylate produced by Southeastern Chemical Corp. of Burlington, N.C., which is designed for use in concentrated caustic systems.

The printed fabric is allowed to stand at room temperature in a substantially tension-free state for a period of from 20 seconds to 20 minutes until the full pucker has developed, after which it is washed in boiling water, neutralized, rinsed, and dried. Washing is carried out with the puckered fabric in a substantially tension-free state. The resulting product is a sheeting having alternate flat and puckered areas.

In the above example, "Discopen-230" (Dixie Size and Chemical Co.), an aliphatic sulfate, and "Wetaid 132-117" (C. H. Patrick & Co., Greenville, S.C.,) which are ammonium salts of mixed sulfated lower alkyl ethers, can be substituted for the "Seccoterge CT".

EXAMPLE 2

This example illustrates the use of a rewetting agent. Polymer-containing goods, as in Example 1, above, were padded with a 1.5% to 3.0% solution of "Wetaid SR Concentrated" (Patrick) at about 70% wet pickup and then dried.

The printing paste used in Example 1, but without the wetting agent, is printed on the dried, rewettable, polymer-containing fabric and allowed to stand at room temperature in a substantially tension-free condition for from 20 seconds to 20 minutes or until full pucker is generated. The puckered fabric was then washed at the boil (minimum tension), neutralized, rinsed, and dried.

As in the case of Example 1, there was obtained a sheeting having alternate flat and puckered areas.

The re-wetting agent used in this example, "Wetaid SR" is a preparation of sodium dioctyl sulfosuccinate marketed by C. H. Patrick & Co. of Greenville, South Carolina.

"Seccoterge LF-G", a blend of an ethoxylated amine and oleylamide, marketed by Southeastern Chemical Co. can be substituted for "Wetaid SR".

"Discopen 230", "Wetaid 132–117", and "Seccoterge CT" are preferred wetting agent for addition to the printing pastes.

Table I, below, lists other wetting agents found suitable for incorporation in the caustic printing paste:

TABLE I

| Proprietary Name | Chemical Classification |
|---|---|
| "Biofac P-35" | Phosphated Ester |
| "Dypenol NF" | Sulfated Alcohol |
| 2-Ethylhexanol | |
| "Triton CF-54" | Non-ionic polyethoxy compound |
| "Triton DN-14" | Alkyl Polyester Alcohol |
| "Karamerse 153" | A low molecular weight sulfated organic surfactant in a water-soluble organic solvent agents. |
| "Renex 30" | Polyoxyethylene Ether Alcohol |
| "Wetaid SR" | Sodium dioctyl sulfosuccinate |
| "Mercopen" | A combination of aliphatic and aromatic alcohol coupled with an ether |
| "Seccoterge LFG" | Blend of ethyloxylated amine and oleylamide |
| "Seccoterge CT" | Modified alcohol ethoxylate |

As illustrated in Example 2, above, "Seccoterge LFG" and "Wetaid SR" can also be used as rewetting agents.

As already noted above, an increasing number of mills are applying pigment color to cotton, a process which involves dry-curing the fabric to which the pigment composition has been applied. The cold puckering process of the present invention is particularly compatible with the pigment coloring procedures. In the following two-part example, there is first set forth a simulated combined pigment and puckering procedure to determine what effect, if any, the curing steps would have on the puckering procedure (Example 3*a*) and then an actual procedure for simultaneously pigment printing and puckering a cotton duck fabric:

EXAMPLE 3

(a) A polymer containing, durable press cotton fabric was printed with the caustic printing paste of Example 1, including in the paste about from 1 to 3% of the wetting agent. The printed fabric was allowed to pucker cold, then dried at 100° C., and finally baked for 2 minutes at 150° C. to simulate curing and setting of the pigment vehicle. Not only did the test fabric retain its pucker but, surprisingly, showed little of the deteriorative effects which one might expect when cotton, containing alkali, is heated for short times in air to 150° C. This was an extremely unexpected phenomenon observed during the simulated pigment curing steps. Alternatively, the fabric was dried and cured at 150° C. simultaneously — instead of sequentially at 100° C. and 150° C.

(b) A cotton duck fabric which had been resin-treated was used in this experiment. The pigment composition was RB-20 which is the official AATCC designation for phthalocyanine blue, Pigment Blue 15 in a resin bonding composition.

Swatches were prepared by printing alternate, adjacent stripes of RB-20 and the caustic printing paste. The printed samples were permitted to pucker for 60 seconds in a tension-free state, dried, and baked for 2 minutes at 150° C. The swatches were then washed, neutralized and dried, producing a cotton duck having flat, white areas where the caustic printing paste had been applied and puckered blue areas where the RB-20 pigment had been printed.

A sample of the puckered fabric described above was overdyed with Direct Yellow 58. There was obtained a swatch having alternate flat, yellow stripes and adjacent blue puckered stripes.

It is historically well known that hot air drying of cotton in an alkaline state promotes and aggravates formation of oxycellulose and induces fiber degradation. Alkali-containing cotton, furthermore, will scorch more readily. Commercial laundries use "sours" to neutralize residual alkali in cotton fabrics. Considering the foregoing, it was most surprising that, on baking, the caustic-treated sections remained equal to or stronger than the original resin treated fabric. The caustic concentration at which this unexpected phenomenon appears most strongly is around 28% by weight (i.e. 40 grams caustic dissolved in 100 grams water).

To further investigate the implications of the above observation, breaking tests were performed under various conditions on strips of a resin-treated, durable press light cotton sateen. The caustic printing paste contained from 1–3% wetting agent and about 28% by weight of sodium hydroxide. Drying and curing temperatures were the same as in Example 3. The procedures and results are described and summarized in the examples which follow.

EXAMPLE 4

This example represents a control in which a sample of the original, resin-treated cotton sateen was found to have a break strength of 29.66 pounds.

EXAMPLE 5

A sample of fabric, as in Example 4, was caustic printed, allowed to pucker cold, and dried only. It broke at 52.95 pounds.

EXAMPLE 6

Another sample of fabric, as in the previous examples, was cold puckered, washed, and then dried. It broke at 57.10 pounds.

EXAMPLE 7

A sample of fabric, as in Example 4, was cold puckered, dried, baked, and then washed. It broke at 44.15 pounds.

Although there is not as much improvement in the strength of the fabric when baked (Example 7) as when it is not baked (Examples 5 and 6), there is, nevertheless, a 42% strength gain retention and a net improvement over the original resin-treated fabric prior to its being subjected to cold puckering.

The following examples represent tests carried out to determine the effect of altering the reducing or oxidizing environment.

EXAMPLE 8

The procedure of Example 7 was repeated, except that 1% by weight of sodium hydrosulfite based on the weight of the printing paste was added to the latter. The fabric, after cold puckering, drying, baking, and washing, as in Example 7, broke at 54.50 pounds.

EXAMPLE 9

Example 8 was repeated, except that formaldehyde sulfoxylate was substituted for the sodium hydrosulfite. The fabric sample broke at 56 pounds.

EXAMPLE 10

Example 8 was again repeated with copper acetate being substituted for the sodium hydrosulfite. The fabric had a breaking strength of 56.65 pounds.

EXAMPLE 11

When Example 8 was repeated, but with sodium perborate being used in place of sodium hydrosulfite, the fabric had a breaking strength of only 27.65 pounds.

The additives to the printing paste in Examples 8, 9, and 10 are reductants and show that, preventing oxidation during the baking steps of the combined cold pucker and pigment printing procedure results in even a greater strength regain than when these additives are not present.

Sodium perborate used in Example 8 is an oxidizing agent which was added for the purpose of aggravating the oxidizing conditions. As will be apparent, its presence in the printing paste results in a strength regain which is even lower than for the control (Example 4).

The following examples demonstrate the effects of varying the amounts of caustic in the printing pastes. In each instance, the various resin-treated fabrics were dried at 100° C. and baked for 2 to 3 minutes at 150° C. to simulate curing conditions for the combined puckering-pigment printing procedure. Results are summarized in the table following each succeeding example.

EXAMPLE 12

Fabric: light cotton sateen

TABLE II

| Percent Caustic in Neutral Paste | Flat Area Strength After Baking |
|---|---|
| 2% | 38.5 lb. |
| 9% | 27.2 lb. |
| 16.7% | 28.9 lb. |
| 23.0% | 31.7 lb. |
| No Caustic | 34.5 lb. |

As will be apparent, increasing the amount of caustic initially results in decreased strength. However, it will be seen from subsequent examples that at about 28% caustic (40 parts by weight of caustic per 100 parts by weight of neutral paste) there is an entirely unexpected and previously unknown decrease in the degrading effect of the caustic on the fabric.

EXAMPLE 13

Fabric: 5 oz. plain weave 100% cotton

TABLE III

| Caustic | Vehicle | Cloth | Strength after Baking |
|---|---|---|---|
| 20 g (16.7%) | 100 g paste | resin-treated | 67.7 lb. |
| 40 g (28.6%) | 100 g paste | resin-treated | 81.2 lb. |
| 20 g (16.7%) | 100 g paste | No resin | 66.7 lb. |
| 40 g (28.6%) | 100 g paste | No resin | 84.5 lb. |

Again the protective inhibiting action of excessive caustic emerges, whether goods was previously (to baking) resin-treated or not. In these tests, initial presence of resin apparently exerted no observed effect.

EXAMPLE 14

This example describes tests to determine the effect of varying the proportion of caustic in the vehicle, the conditions of treatment otherwise remaining the same.

Break tests were carried out on 5 ounce, resin-treated, 100% cotton duck which had been pretreated with "Wetaid SR", as the rewetting agent. After application of the rewetting agent the fabric was caustic printed, dried at 100° C. and then baked for 2 minutes at 150° C.

The first five runs (*a–e*) listed in Table IV, below, were carried out with both the standard paste to which 3% "Seccoterge CT" was added as a wetting agent, and with similar strength caustic solution without the thickeners (*g–k*). Results for the (*a–e*) series of runs which represent treatment with caustic but eliminating baking are given in parenthesis in the table.

TABLE IV

| Grams Caustic | Grams Vehicle | Break Lbs. |
|---|---|---|
| (a) 35 | 100 Paste | 82.75 (86.25*) |
| (b) 40 | 100 Paste | 92.00 (91.50*) |
| (c) 50 | 100 Paste | 87.00 (88.50*) |
| (d) 60 | 100 Paste (Wet Poorly) | 85.00 (85.25*) |
| (e) 70 | 100 Paste (Wet Poorly) | 88.75 (92.50*) |
| (f) — | Control Only | 79.75 |
| (g) 35 | 100 Water | 87.00 |
| (h) 40 | 100 Water | 87.75 |
| (i) 50 | 100 Water | 85.75 |
| (j) 60 | 100 Water (Wet Poorly) | 79.00 |
| (k) 70 | 100 Water (Wet Poorly) | 84.50 |

*Vehicle is normal paste plus wetting agent; goods were not baked or dried, but washed directly after cold pucker. FIGS. represent gain due to shrinkage and removal of cross linking polymer.

The figures in parenthesis for the "not baked" samples show strength increase due to caustic shrinkage alone. The drying and baking did not significantly alter these figures. However, consistent with the results of the previous examples, a concentration of 40 parts by weight of caustic in 100 parts by weight of vehicle, representing about 28.6% caustic in the printing paste, produced a maximum breaking strength.

EXAMPLE 15

The first three runs (*a–c*) in Example 14 were repeated to determine the effect of omitting the rewetting agent from the fabric, using only a printing paste containing 3% "Seccoterge CT". The results are given in Table V, below.

TABLE V

| Grams Caustic | Grams Paste | Dried and Baked | Not Dried or Baked |
|---|---|---|---|
| 35 | 100 | 72.0 lbs. | 91.5 lbs. |
| 40 | 100 | 80.0 lbs. | 91.0 lbs. |
| 50 | 100 | 67.0 lbs. (Wet Poorly) | 89.5 lbs. |
| | | Control | 77.75 lbs. |

In these tests the combined actions of the wetting agent in the paste plus rewetting agent in the resin treated fabric showed slightly less strength retention after baking than wetting agent in paste only. Once again, the singular protective action of 28% caustic emerged.

Bearing in mind that cotton, itself, begins to deteriorate slowly at 150° C. a series of further tests were carried out to determine the effect on strength under a variety of conditions. These tests are summarized in the self-explanatory examples and tables which follow. The consistently observed results, as will become apparent, confirm the totally unexpected protective action of 40 to 44 parts by weight of caustic added to 100 parts of neutral paste.

EXAMPLE 16

This example once more illustrates the effect of caustic concentration in paste on strength retention of light resinated cotton when baked 3 minutes at 150° C.

TABLE VI

| Grams caustic added to 100 grams paste | Baked strength, pounds |
|---|---|
| 10 | 27.2 |
| 20 | 28.9 |
| 30 | 31.7 |
| 40 | 44.9 |
| Control, no caustic, baked neutral | 29.7 |

The baked strength includes gain due to both caustic attack on cross-links and shrinkage.

Strength of original (unresinated) goods was 37.25 lbs.; resinated: 29.7 lbs.

EXAMPLE 17

The effects of various treatments prior to baking for 3 minutes, at 150° C., were determined for a light, resinated cotton printed with a 30% caustic printing paste:

| | |
|---|---|
| 1. Not baked, printed, washed wet then dried | 57.1 lbs. |
| 2. Printed, dried, washed, dried | 52.9 lbs. |
| 3. Printed, dried, baked | 44.2 lbs. |
| 4. Printed, dried, steamed (not baked) | 54.5 lbs. |
| 5. "As is " resinated cotton, control | 29.6 lbs. |

EXAMPLE 18

Effect of the depth of penetration of the caustic printing paste was investigated. The results observed were as follows:

Baking at 150° C., 2 minutes; 30% caustic in print paste. Screen print, 5 oz. plain weave.

| | |
|---|---|
| 1 stroke of squeegee | 85.5 lb. |
| 3 strokes of squeegee | 89.0 lb. |
| 5 strokes of squeegee | 82.7 lb. |

The above results indicate that the depth of penetration of the print is not too critical for strength retention in baking.

EXAMPLE 19

Inhibitive effect of alkali on heat deterioration.

In this example, samples of a resinated 5 ounce, plain weave 100% cotton fabric were impregnated with a rewetting agent ("Wetaid SR"), dried, and then treated with the caustic compositions indicated in Table III. The wetting agents were present in the pastes or aqueous solutions. The caustic treated samples were then baked for 2 minutes at 150° C.; after which they were tested for breaking strength.

TABLE VII

| Caustic added to 100 grams vehicle | Baked strength |
|---|---|
| 35 g. (to paste) (26% caustic) | 82.7 lbs. |
| 40 g. (to paste) (28.6% caustic) | 92.0 lbs. |
| 50 g. (to paste) (33.3% caustic) | 85.0 lbs. |
| 35 g. (to water only) | 86.3 lbs. |
| 40 g. (to water only) | 91.5 lbs. |
| 50 g. (to water only) | 88.5 lbs. |
| Control (resinated only) | 75.8 lbs. |

EXAMPLE 20

Inhibitive effect of strong caustic using heavy goods (rewetting agent in goods):

TABLE VIII

| Caustic added to paste | Gain due to shrinkage* | Net gain on baking 2 min. at 150° C. | Loss due to baking |
|---|---|---|---|
| 35 grams | 10.45 lb. | 6.95 lb. | 3.5 lb. |
| 40 grams | 15.70 lb. | 16.2 lb. | no loss |
| 50 grams | 12.70 lb. | 11.7 lb. | 1.0 lb. |

*actually shrinkage plus crosslink destruction.

Strength gain due to shrinkage was 91.5 − 75.8 = 15.7 lbs. Therefore, the optimum alkali concentration does not increase strength; it protects from serious degradation.

EXAMPLE 21

Inhibitive effect of strong caustic, using light goods (rewetting agent in goods), 30% caustic paste. Baked 2 minutes — 150° C.

| | | | (net gain) |
|---|---|---|---|
| 1. | Gain due to shrinkage* | 27.5 lbs. | (27.5 lb) |
| 2. | Loss on drying only | 4.2 lbs. | (23.3 lb) |
| 3. | Loss on drying and baking | 12.9 lbs. | (14.6 lb) |

*Actually shrinkage plus crosslink destruction.

This lighter goods evidently is more accessible to caustic and to oxygen during baking.

All drying and baking in the foregoing examples were in moving air in a Benz Heat Transfer unit. When baked at 160° C. the heavier goods was about 7 to 10% weaker than the 150° C. bakes. At 200° C. all were destroyed in 2–3 minutes. Neutral cotton would not be destroyed. The 5 ounce resin-treated goods were passed through the Benz at 200° C. and 105 seconds dwell time with the following results:

| Neutral Fabric | Strength |
|---|---|
| Resin treated-cured at 150° C., not baked | 76.2 lbs. |
| Resin treated-cured at 150° C., baked at 200° C. | 63.7 lbs. (12.5 pound strength loss) |

The observed 12.5 pound strength loss is considerable. Nevertheless, the neutral fabric, although very yellow and with a scorched odor, was still intact. The protective action of 30% caustic was still fairly effective for 2 minutes at 160° C. but goods were badly deteriorated after 170° C. baking. As noted, higher or lower caustic concentrations seem to allow more deterioration than does 28% to 30% at 150° C., indicating that optimum conditions exist for the unexpected combination of about 30% caustic and 150° C. baking temperature.

The method of the invention is obviously not restricted to the above resin pick-up, drying temperature, curing time and temperature, but will vary with the specific resin or combinations of resins used, fabric density, and other variable conditions familiar to those skilled in the fabric finishing art.

Although the invention has been described above with reference to a particular general procedure and crosslinking composition, as well as to two alternate cold puckering procedures, variations and modifications of the compositions of the resinous crosslinking agents and wetting agents, as well as of the dyeing and pigment printing procedures, will become apparent to those skilled in the art. It will also be apparent that the foregoing examples are merely illustrative of the invention and that the latter is not limited thereby except as defined in the claims below.

We claim:

1. A process for imparting durable pucker and color effects to an undyed, dyed or printed, cured, polymer containing, crosslinked, cellulose-fiber containing durable press fabric composed of 100% cotton or of a blend containing at least 40% cotton fiber, which process comprises:

(a) applying an aqueous caustic solution containing 25 to 33.3% caustic soda by weight to the crosslinked fabric in selected areas thereof and also applying to said cross-linked fabric a surface active agent either as part of the said caustic solution or as a separate solution which is applied and dried prior to application of said caustic solution, said caustic solution being of sufficient concentration to destroy said polymer and cellulose crosslinks in said selected areas, said wetting agent being capable of causing said printing paste to penetrate the fibers of said crosslinked fabric in the absence of elevated temperatures, and said wetting agent being alkali resistant if applied as part of said caustic solution;

(b) allowing the caustic treated fabric to stand substantially at room temperature in a substantially tension-free state for from about 2 to about 20 minutes until said caustic treated portions have shrunk to produce flat uncrosslinked areas and contiguous unshrunk, puckered areas; and (c) washing, neutralizing, rinsing and drying the puckered fabric.

2. The process of claim 1 wherein the caustic is applied as a thickened aqueous printing paste.

3. The process of claim 2 wherein the fabric is made durably press retentive prior to the caustic application by impregnating it with (a) a resin-forming cellulose crosslinking agent comprising a dimethylol cyclic aminoplast resin precondensate, (b) a polymer former and (c) an acidic catalyst, curing the impregnated fabric by heating to insolubilize the crosslinking agent and polymer former in the fibers of said fabric and to crosslink and stabilize the cellulose of said fabric, and washing and drying said cured fabric.

4. The process of claim 2 wherein the caustic paste is applied in a pattern to a dyed, crosslinked fabric.

5. The process of claim 2 wherein the puckered fabric is dyed after the pucker has developed.

6. The process of claim 3 wherein the wetting agent is included in the aqueous printing paste and the paste is printed on the fabric in a pattern.

7. The process of claim 6 wherein the wetting agent is an aliphatic sulfate or a salt of a sulfated lower alkyl ether.

8. The process of claim 7 wherein the fabric was dyed prior to crosslinking.

9. The process of claim 7 wherein the fabric is dyed after the pucker has developed.

10. The process of claim 2 wherein the fabric is a cotton-polyester blend containing at least 40% cotton.

11. The process of claim 2 wherein the cured, crosslinked fabric is impregnated with an aqueous solution of a re-wetting agent and dried before said aqueous caustic printing paste is applied thereto.

12. The process of claim 11 wherein the re-wetting agent is an alkoxylated amine blended with oleylamide or sodium dioctyl sulfosuccinate.

13. The process of claim 11 wherein the re-wetting agent is applied to a previously dyed, crosslinked fabric.

14. The process of claim 11 wherein the fabric is a cotton-polyester blend containing at least 40% cotton.

15. The process of claim 11 wherein the fabric is 100% cotton.

16. A process for producing a cellulose fiber containing fabric having durable pucker and color effects and improved strength retention which comprises the steps of:

(a) applying a heat-setting pigment-containing composition to a durably press-retentive, cured, polymer-containing, cross-linked, cellulose-containing fabric composed of 100% cotton fiber or a fiber blend containing at least 40% cotton;

(b) printing on selected areas of the resulting pigment-bearing fabric an aqueous caustic printing paste containing 35 to 50 parts caustic per 100 parts by weight neutral paste and an alkali-resistant wetting agent capable of causing said caustic paste to penetrate the fibers of said fabric in the absence of elevated temperatures;

(c) allowing the fabric to stand at room temperature in a substantially tension-free state for from about 2 to about 20 minutes until the cellulose crosslinks are destroyed and the fibers are shrunk in the areas of the fabric on which the caustic paste was printed, thereby producing flat, uncrosslinked areas and contiguous unshrunk puckered areas;

(d) drying the puckered fabric;

(e) baking the caustic-containing fabric at an elevated temperature for a time sufficient to set the pigment; and (f) washing, neutralizing, rinsing and drying the baked fabric.

17. A process according to claim 16 wherein the heat-setting pigment composition in step (a) and the caustic paste in step (b) are applied to the fabric in alternate, adjacent areas, resulting in a contrasting color effect.

18. A process according to claim 16 wherein the wetting agent in the caustic paste in step (b) is a member selected from the group consisting of lower aliphatic sulfates and phosphates, salts of sulfated lower alkyl ethers, alkoxylated amines, blends of alkoxylated amines with higher fatty acid amides, and salts of sulfonated esters of lower aliphatic dibasic carboxylic acids.

19. The process of claim 16 wherein the pigment composition and the caustic printing paste are applied to a crosslinked 100% cotton fabric, and the puckered fabric containing the caustic paste is baked at between about 150° and 160° C. for about 2 to 3 minutes.

20. The process of claim 16 wherein the polymer-containing crosslinked fabric is a cotton-polyester blend fabric containing at least 40% cotton fibers, and the puckered fabric containing the caustic paste is baked at between about 150° and 160° C. for about 2 to 3 minutes.

21. The process of claim 16 wherein the caustic printing paste contains about 28 to about 30% caustic soda by weight and wherein the puckered fabric containing the caustic paste is baked at between about 150° to 160° C. for about 2 to 3 minutes.

22. The process of claim 21 wherein the heat-setting pigment composition and the caustic paste are printed on the fabric in alternate, adjacent areas.

* * * * *